US009936293B2

(12) United States Patent
Enamito et al.

(10) Patent No.: US 9,936,293 B2
(45) Date of Patent: Apr. 3, 2018

(54) SOUND REPRODUCTION APPARATUS, A NON-TRANSITORY COMPUTER READABLE MEDIUM, AND A SOUND REPRODUCTION-CORRECTION METHOD

(71) Applicant: Kabushiki Kaisha Toshiba, Minato-ku (JP)

(72) Inventors: Akihiko Enamito, Kanagawa-ken (JP); Takahiro Hiruma, Tokyo (JP); Osamu Nishimura, Kanagawa-ken (JP)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 725 days.

(21) Appl. No.: 14/044,174

(22) Filed: Oct. 2, 2013

(65) Prior Publication Data

US 2014/0286501 A1 Sep. 25, 2014

(30) Foreign Application Priority Data

Mar. 19, 2013 (JP) ..... 2013-056718

(51) Int. Cl.
*H04R 3/04* (2006.01)
*H04R 1/10* (2006.01)

(52) U.S. Cl.
CPC ..... *H04R 3/04* (2013.01); *H04R 1/1091* (2013.01)

(58) Field of Classification Search
CPC ..... G10K 11/16
USPC ..... 381/74, 303, 71.6; 330/259
See application file for complete search history.

(56) References Cited

U.S. PATENT DOCUMENTS 4,703,284 A * 10/1987 Barbu ..... H03F 3/195 330/259
2011/0261971 A1* 10/2011 Miseki ..... H04R 3/04 381/71.6
2013/0108069 A1* 5/2013 Lee ..... H04R 1/1033 381/74
2015/0230041 A1* 8/2015 Fejzo ..... H04R 5/02 381/303

FOREIGN PATENT DOCUMENTS

JP 2010-81071 4/2010
JP 2011-234047 A 11/2011

OTHER PUBLICATIONS

Notification of Reasons for Refusal issued Jul. 8, 2016, in Japanese Patent Application No. 2013-056718 (with English-language translation).

* cited by examiner

*Primary Examiner* — Md S Elahee
(74) *Attorney, Agent, or Firm* — Oblon, McClelland, Maier & Neustadt, L.L.P.

(57) ABSTRACT

According to one embodiment, a loudspeaker is provided in a case of an earphone. The case closes an external auditory canal extended from a tympanum of a listener. The earphone has an opening toward the external auditory canal. In an apparatus for generating a sound reproduction to the loudspeaker, a storage unit stores a correction filter in which a maximum of a gain at a frequency band lower than or equal to 10 kHz is larger than a maximum of a gain at a frequency band higher than 10 kHz. An acquisition unit acquires a first sound reproduction signal. A correction unit generates a second sound reproduction signal by convoluting the correction filter with the first sound reproduction signal. An output unit outputs the second sound reproduction signal to the loudspeaker.

16 Claims, 11 Drawing Sheets

SOUND REPRODUCTION APPARATUS, A NON-TRANSITORY COMPUTER READABLE MEDIUM, AND A SOUND REPRODUCTION-CORRECTION METHOD

CROSS-REFERENCE TO RELATED APPLICATION

This application is based upon and claims the benefit of priority from Japanese Patent Application No. 2013-056718, filed on Mar. 19, 2013; the entire contents of which are incorporated herein by reference.

FIELD

Embodiments described herein relate generally to a sound reproduction apparatus, a non-transitory computer readable medium, and a sound reproduction-correction method.

BACKGROUND

When a listener listens to a music and so on (sound reproduction) by inserting an earphone into the listener's ear, the sound is propagated in order of the earphone, the listener's external auditory canal, and the listener's tympanum. Here, unnecessary resonance characteristic of external auditory canal is acquired by echo from the earphone (reflector), and original necessary resonance characteristic of external auditory canal is lost. In order to avoid this defect, the sound reproduction is amended by suppressing the unnecessary resonance characteristic of external auditory canal and by adding the necessary characteristic. Briefly, a sound reproduction apparatus to near a sound quality in case of insertion of the earphone to a (natural) sound quality in case of non-insertion of the earphone is proposed.

In such sound reproduction apparatus, various earphones are used by the listener to listen to the sound reproduction. Accordingly, even if different earphones are used, it is expected that the sound quality can be improved as mentioned-above.

DETAILED DESCRIPTION

According to one embodiment, an apparatus generates a sound reproduction to a loudspeaker provided in a case of an earphone. The case closes an external auditory canal extended from a tympanum of a listener. The earphone has an opening toward the external auditory canal. The apparatus includes a storage unit, an acquisition unit, a correction unit, and an output unit. The storage unit is configured to store a correction filter in which a maximum of a gain at a frequency band lower than or equal to 10 kHz is larger than a maximum of a gain at a frequency band higher than 10 kHz. The acquisition unit is configured to acquire a first sound reproduction signal. The correction unit is configured to generate a second sound reproduction signal by convoluting the correction filter with the first sound reproduction signal. The output unit outputs the second sound reproduction signal to the loudspeaker.

Various embodiments will be described hereinafter with reference to the accompanying drawings.

The First Embodiment

Figure 1:
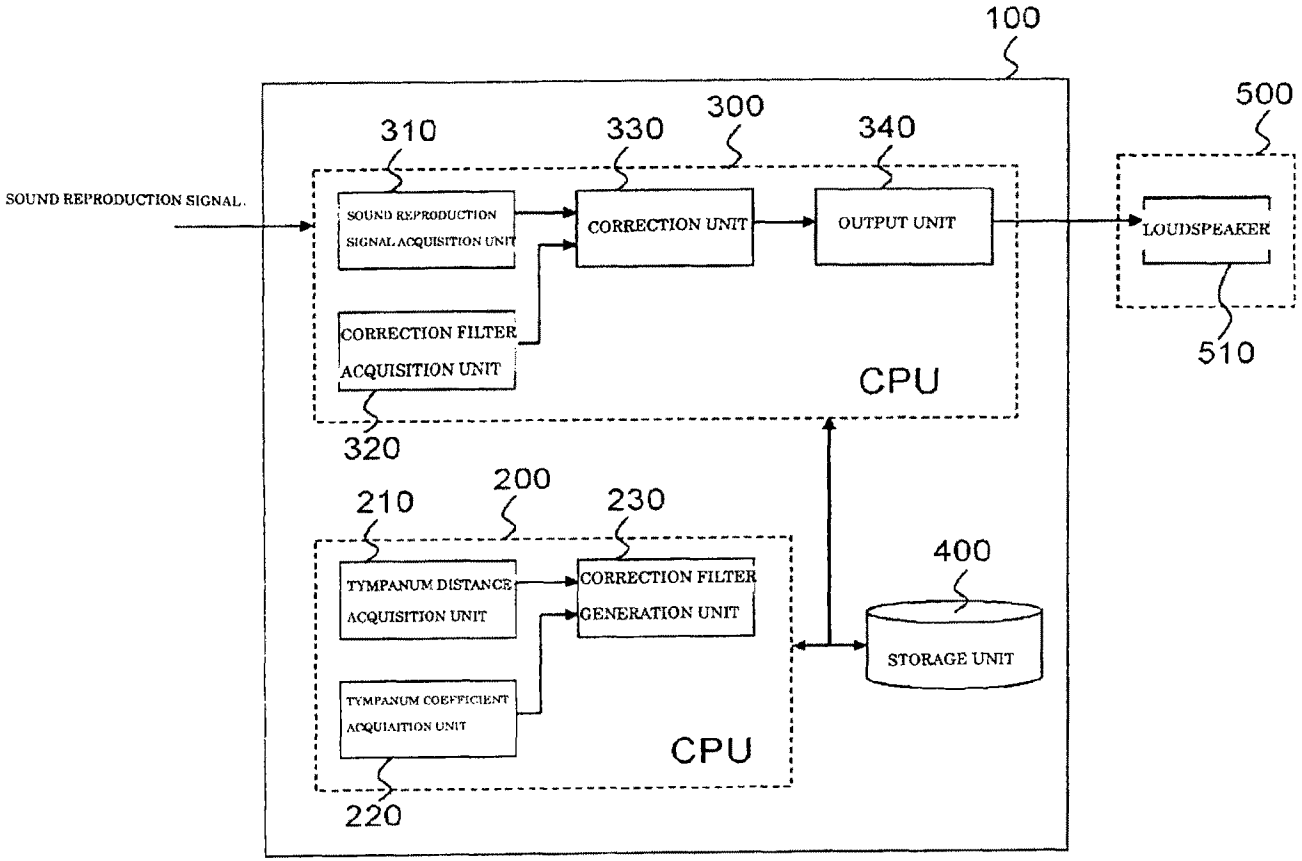
FIG. 1 is a block diagram of a sound reproduction apparatus according to the first embodiment.

FIG. 1 is a block diagram of a sound reproduction apparatus 100 according to the first embodiment. For example, the sound reproduction apparatus 100 is used by an electronic device able to listen to a music or a voice (Hereinafter, they are called "sound reproduction") using an earphone of a PC (Personal Computer), a cellular-phone, a tablet terminal, a music player, a TV (Television), a radio and so on.

In FIG. 1, the sound reproduction apparatus 100 includes a generation unit 200 and a correction unit 300. The generation unit 200 generates a correction filter to correct a sound reproduction signal. The correction unit 300 corrects the sound reproduction signal using the correction filter (generated by the generation unit 200). An earphone 500 can be wirely or wirelessly connected to the sound reproduction apparatus 500 via an earphone jack (not shown in FIG. 1). The sound reproduction signal corrected by the correction unit 300 is outputted to a loudspeaker 510 of the earphone 500. A storage unit 400 stores each datum (tympanum distance, tympanum coefficient and so on (explained afterwards)) to generate the correction filter. Furthermore, the storage unit 400 is used as a buffer to temporarily store the correction filter. By inserting the earphone 500 into the listener's ear to block up his/her external auditory canal, the listener listens to the sound reproduction outputted by the sound reproduction apparatus 100.

Moreover, in the sound reproduction apparatus 100, by reading a control program stored in a ROM and by extending this program onto a RAM, a CPU functions as the generation unit 200 and the correction unit 300. Here, the storage unit 400 is a memory including the ROM and the RAM.

In FIG. 1, by using an acoustic propagation model in the listener's external auditory canal in case of insertion of earphone, and by using an acoustic propagation model in the listener's external auditory canal in case of non-insertion of earphone, the generation unit 200 generates a correction filter to correct from an acoustic characteristic in case of insertion of earphone to an acoustic characteristic in case of non-insertion of earphone.

Figure 2A:
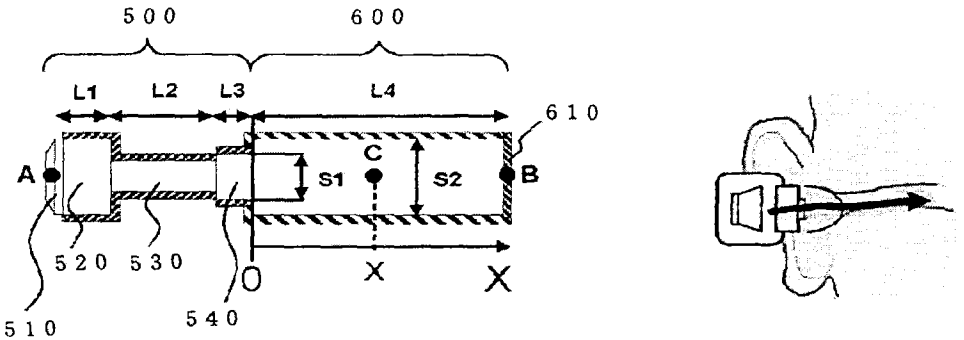
FIGS. 2A and 2B are schematic diagrams of an acoustic propagation route according to the first embodiment.
Figure 2B:
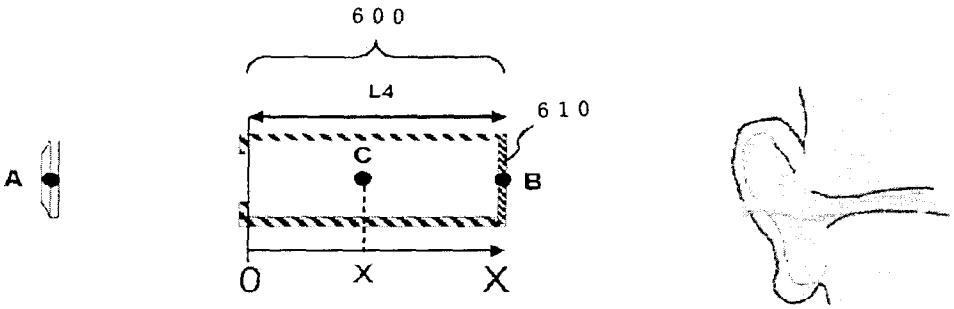

Hereinafter, the correction filter will be explained by referring to FIGS. 2~4. FIG. 2A shows an external auditory canal model in case of insertion of earphone, and FIG. 2B shows an external auditory canal model in case of non-insertion of earphone.

As shown in FIG. 2A, as an acoustic propagation route in case of insertion of the earphone 500, an acoustic tube model including a case 520 (length $L_1$) of the earphone, a nozzle 530 (length $L_2$), an ear chip 540 (length $L_3$, sectional area $S_1$), and the listener's external auditory canal 600 (length $L_4$, sectional area $S_2$), is used. Moreover, the case, the nozzle, the ear chip, and the external auditory canal, are assumed to have a cylindrical shape.

In this acoustic tube model, a sound reproduction radiated from the loudspeaker 510 positioned at A is reflected by a tympanum 610 (acoustic impedance $Z_d$) positioned at B. Here, a spatial transfer function (acoustic propagation model) $H_{close}$ arbitrarily positioned at C having a distance x from the origin O (exit of earphone or entrance of external auditory canal) in the external auditory canal is represented as an equation (1). Here, P(x) is a sound pressure at position C, $P_0$ is a sound pressure (radiated from loudspeaker) at position A, ρ is an air density, c is a speed of sound, and k is a wave number. Furthermore, $w_{(1,1)}$ and $w_{(1,2)}$ are given as an element of a transfer matrix W representing characteristic of the earphone.

$$H_{close} = \frac{P(x)}{P_0} = \frac{Z_d\cos k(L_4 - x) + j\rho c\sin k(L_4 - x)}{\rho c\cos kL_4 + jZ_d\sin kL_4} \times \rho c \cdot \frac{S_1}{S_2} \cdot \frac{1}{w_{(1,1)} \cdot \frac{Z_d\cos kL_4 + j\rho c\sin kL_4}{\rho c\cos kL_4 + jZ_d\sin kL_4} \cdot \frac{S_1}{S_2}\rho c + w_{(1,2)}} \tag{1}$$

$$W = H_1 \cdot H_2 \cdot H_3 = \begin{pmatrix} w_{(1,1)} & w_{(1,2)} \\ w_{(2,1)} & w_{(2,2)} \end{pmatrix} = \begin{pmatrix} \cos kL_1 & j\rho c\sin kL_1 \\ j\frac{\sin kL_1}{\rho c} & \cos kL_2 \end{pmatrix} \begin{pmatrix} \cos kL_2 & j\rho c\sin kL_2 \\ j\frac{\sin kL_2}{\rho c} & \cos kL_2 \end{pmatrix} \begin{pmatrix} \cos kL_3 & j\rho c\sin kL_3 \\ j\frac{\sin kL_3}{\rho c} & \cos kL_3 \end{pmatrix} \tag{2}$$

Furthermore, as shown in FIG. 2B, as an acoustic propagation route in case of non-insertion of earphone, an acoustic tube model including a free space and the listener's external auditory canal 600 (length $L_4$, sectional area $S_2$), is used.

In this acoustic tube model, a sound reproduction radiated from the loudspeaker 510 positioned at A is propagated to the origin O in the free space (air), and intruded into the external auditory canal. The sound reproduction intruded into the external auditory canal is reflected by a tympanum 610 (acoustic impedance $Z_d$) positioned at B. Here, amplitude attenuation of the sound reproduction does not occur in the free space from the loudspeaker 510 to the external auditory canal 600, and a transfer matrix W in the equation (2) is an identity matrix. Briefly, by substituting $w_{(1,1)}=1$ and $w_{(1,2)}=0$ for the equation (1), a spatial transfer function (acoustic propagation model) $H_{open}$ arbitrarily positioned at C having a distance x from the origin O (exit of earphone or entrance of external auditory canal) in the external auditory canal is represented as an equation (3).

$$H_{open} = \frac{P(x)}{P_0} = \frac{Z_d\cos k(L_4 - x) + j\rho c\sin k(L_4 - x)}{\rho c\cos kL_4 + jZ_d\sin kL_4} \tag{3}$$

-continued $$\rho c \cdot \frac{S_1}{S_2} \cdot \frac{1}{\frac{Z_d\cos kL_4 + j\rho c\sin kL_4}{\rho c\cos kL_4 + jZ_d\sin kL_4} \cdot \frac{S_1}{S_2}\rho c} = \frac{Z_d\cos k(L_4 - x) + j\rho c\sin k(L_4 - x)}{Z_d\cos kL_4 + j\rho c\sin kL_4}$$

From the above, by using the spatial transfer function (equation (1)) in case of insertion of earphone and the spatial transfer function (equation (3)) in case of non-insertion of earphone, at an arbitrary position C having a distance x from the origin X, a correction function Q(x) to correct from an acoustic characteristic in case of insertion of earphone to an acoustic characteristic in case of non-insertion of earphone is represented as an equation (4).

$$Q(x) = \frac{H_{open}}{H_{close}} = \frac{\frac{Z_d\cos k(L_4 - x) + j\rho c\sin k(L_4 - x)}{Z_d\cos kL_4 + j\rho c\sin kL_4}}{\frac{Z_d\cos k(L_4 - x) + j\rho c\sin k(L_4 - x)}{\rho c\cos kL_4 + jZ_d\sin kL_4}\rho c \cdot \frac{S_1}{S_2} \cdot \frac{1}{w_{(1,1)} \cdot \frac{Z_d\cos kL_4 + j\rho c\sin kL_4}{\rho c\cos kL_4 + jZ_d\sin kL_4} \cdot \frac{S_1}{S_2}\rho c + w_{(1,2)}}} \tag{4}$$

As shown in the equation (4), the correction function Q(x) is a function having variables, i.e., a size of earphone (length $L_1$~$L_3$ along X-axis direction), a size of external auditory canal (length $L_4$ along X-axis direction), a ratio of sectional area $S_1$ perpendicular to X-axis at exit of earphone to sectional area $S_2$ perpendicular to X-axis at entrance of external auditory canal, an impedance $Z_d$ of tympanum, and the wave number k(=2πf/c, f: frequency). Briefly, by substituting x=$L_4$ for the equation (4), at the tympanum in the external auditory canal, the acoustic characteristic in case of insertion of earphone can be corrected to the acoustic characteristic in case of non-insertion of earphone.

Accordingly, by substituting each variable ($L_1$, $L_2$, $L_3$, $L_4$, $S_1$, $S_2$, $Z_d$, k) and each constant (ρ, c) for the equation (4), the correction filter Q to correct the acoustic characteristic at the listener's tympanum position B (x=$L_4$) is represented as an equation (5).

$$Q = \frac{\frac{Z_d}{Z_d\cos kL_4 + j\rho c\sin kL_4}}{\frac{Z_d}{\rho c\cos kL_4 + jZ_d\sin kL_4}\rho c \cdot \frac{S_1}{S_2} \cdot \frac{1}{w_{(1,1)} \cdot \frac{Z_d\cos kL_4 + j\rho c\sin kL_4}{\rho c\cos kL_4 + jZ_d\sin kL_4} \cdot \frac{S_1}{S_2}\rho c + w_{(1,2)}}} \tag{5}$$

By correcting the sound reproduction using the correction filter Q (equation (5)), a sound quality in case of insertion of earphone is neared to a (natural) sound quality in case of non-insertion of earphone. As a result, the sound quality can be improved.

Figure 3:
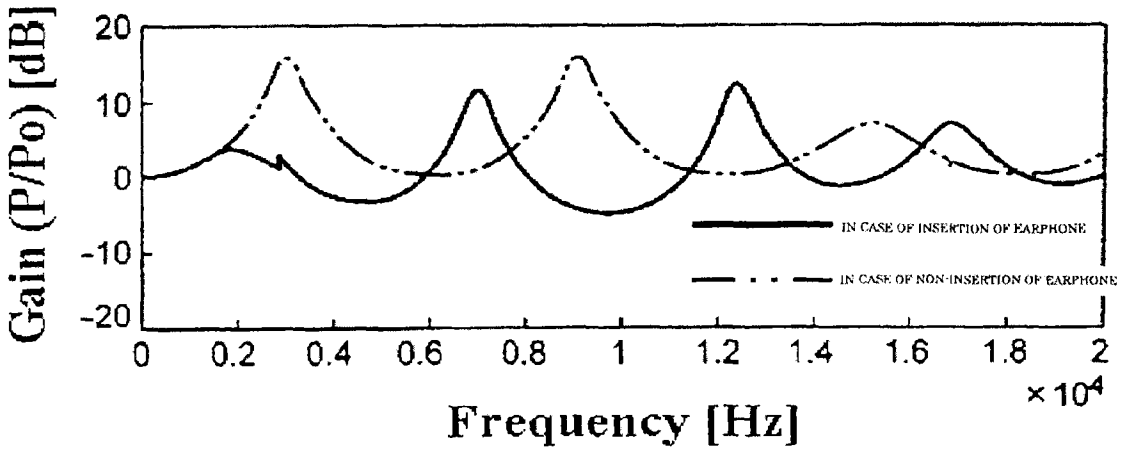
FIG. 3 is a schematic diagram showing an acoustic propagation model according to the first embodiment.

FIG. 3 shows one example of acoustic propagation models in case of insertion of earphone and in case of non-insertion of earphone. In FIG. 3, an acoustic propagation model in case of insertion of earphone (represented by a solid line) includes a peak of gain (closed resonance characteristic) around 7 kHz (first closed resonance frequency), 12 kHz (second closed resonance frequency), and 17 kHz (third closed resonance frequency). On the other hand, an acoustic propagation model in case of non-insertion of earphone (represented by two-dot chain line) includes a peak of gain (open resonance characteristic) around 3 kHz (first open resonance frequency), 9 kHz (second open resonance frequency), and 15 kHz (third open resonance frequency).

Figure 4A:
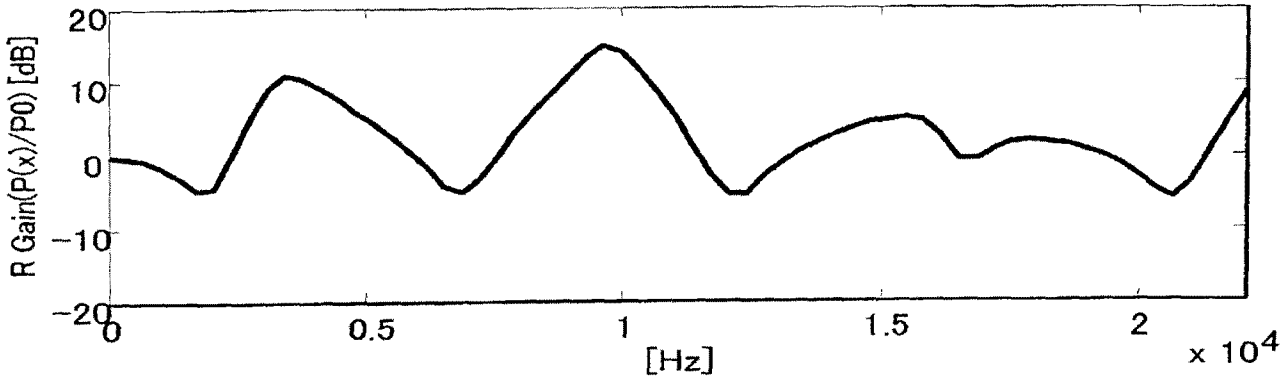
FIGS. 4A and 4B are schematic diagrams showing a correction filter according to the first embodiment.
Figure 4B:
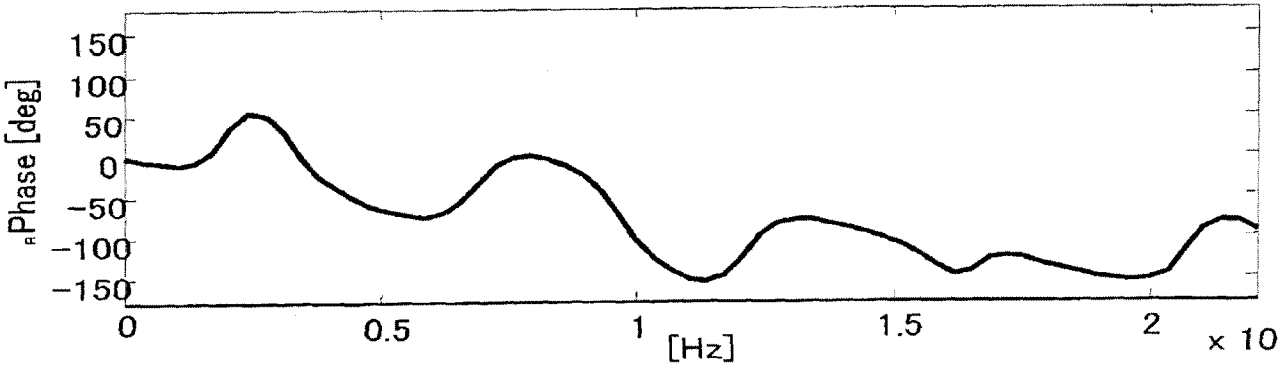

FIGS. 4A and 4B show one example of the correction filter generated using the acoustic propagation model shown in FIG. 3. In this example, a tympanum coefficient $Z_d$ smaller than 3 kHz (first open resonance frequency) is $\sqrt{2}\times\rho c$, and a tympanum coefficient $Z_d$ larger than (or equal to) 3 kHz is $\sqrt{10}\times\rho c$. In FIG. 4, the correction filter has a notch including a minimum at a frequency equivalent to the closed resonance frequency (second resonance frequency) shown in FIG. 3. Furthermore, the correction filter has a peak including a maximum at a frequency equivalent to the open resonance frequency (first resonance frequency) shown in FIG. 3. Briefly, by convoluting this correction filter with the sound reproduction signal, the closed resonance occurred in the external auditory canal in case of insertion of earphone can be suppressed by the notch included in the correction filter, and the open resonance occurred in the external auditory canal incase of non-insertion of earphone can be added by the peak included in the correction filter.

In the first embodiment, based on the correction filter Q shown in the equation (5), in order to further improve the sound quality irrespective of individual difference of earphone, a particle velocity of the sound reproduction is noticed.

Hereinafter, by referring to FIG. 5, relationship between the particle velocity of sound reproduction and the individual difference of earphone will be explained.

The particle velocity $V_4$ at entrance of the listener's external auditory canal satisfies an equation (6).

$$V_4 = \frac{S_1}{S_2}\cdot\frac{P_0}{w_{(1,1)}\cdot\dfrac{Z_d\cos kL_4 + j\rho c\sin kL_4}{\rho c\cos kL_4 + jZ_d\sin kL_4}\cdot\dfrac{S_1}{S_2}\rho c + w_{(1,2)}} \tag{6}$$

As shown in the equation (6), the particle velocity $V_4$ is affected by an external auditory canal-characteristic ($L_4$, $Z_d$), an earphone-characteristic (w(1,1), w(1,2)), and a ratio of a sectional area $S_1$ at exit of earphone to a sectional area $S_2$ at entrance of external auditory canal. Briefly, if the external auditory canal-characteristics are common, the particle velocity is changed by differentiating the earphone-characteristic. Accordingly, the particle velocity is a parameter related to the individual difference of earphone.

Here, by representing the correction filter of the equation (5) using the particle velocity $V_4$, an equation (7) is acquired.

$$Q = \frac{\dfrac{Z_d}{Z_d\cos kL_4 + j\rho c\sin kL_4}}{\dfrac{Z_d}{\rho c\cos kL_4 + jZ_d\sin kL_4}}\cdot\frac{P_0}{\rho c}\cdot\frac{1}{V_4} \tag{7}$$

Accordingly, even if type (size and so on) of the earphone is changed, if the particle velocity at entrance of the external auditory canal is almost constant, the correction filter Q is hard to be affected by individual difference of earphone. Briefly, if a frequency band (robust band) of which particle velocity is almost constant exists, even if the correction filter is generated based on size of arbitrary earphone, this robust band can be commonly used irrespective of type of the earphone.

Figure 5A:
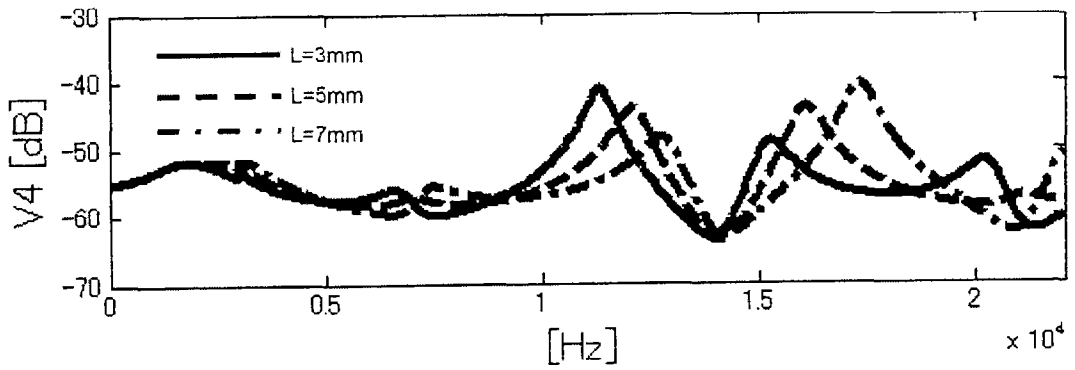
FIGS. 5A and 5B are graphs showing change of a particle velocity by an earphone characteristic according to the first embodiment.
Figure 5B:
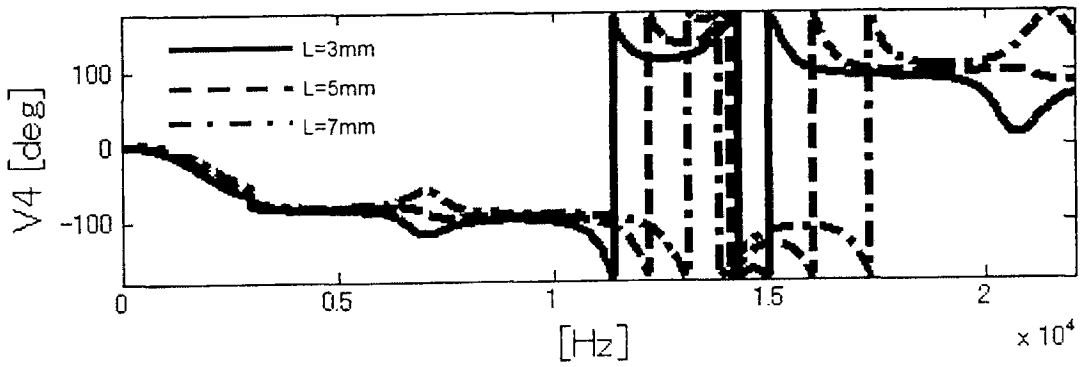
Figure 6:
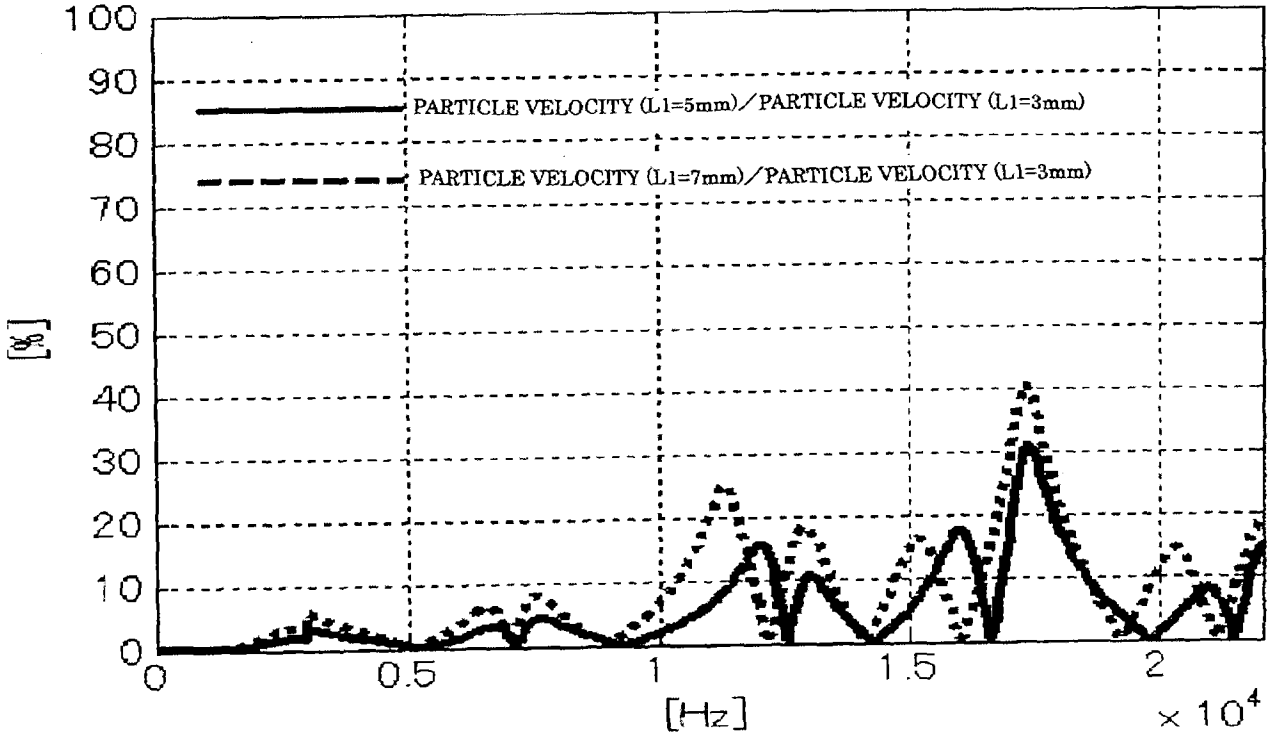
FIG. 6 is another graph showing change of the particle velocity by the earphone characteristic according to the first embodiment.

FIGS. 5A and 5B show the particle velocity, on condition that an inner diameter D of a case of the earphone is constantly $10.5_{mm}$, when a length $L_1$ of the case is changed as "$3_{mm}\rightarrow 5_{mm}7_{mm}$". Furthermore, FIG. 6 shows the particle velocity of the length $L_1$ "$5_{mm}$" and "$7_{mm}$." in comparison with the length $L_1$ "$3_{mm}$". From this, in a band smaller than (or equal to) 10 kHz, a change amount of the particle velocity by a size of the earphone is smaller than (or equal to) 10% for all bands within 10 kHz. This change amount is sufficiently smaller than a change amount of the particle velocity in a band higher than 10 kHz. Accordingly, in the first embodiment, a band smaller than (or equal to) 10 kHz is defined as robust band of which particle velocity is almost constant.

Next, by referring to FIGS. 7A~7C, relationship between an acoustic energy of sound reproduction to be generally listened and the robust band will be explained.

Figure 7A:
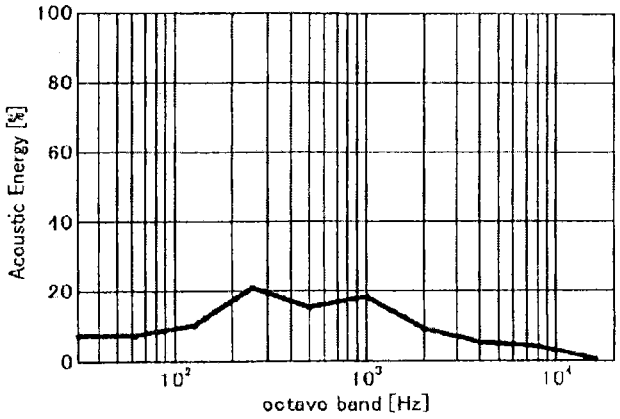
FIGS. 7A, 7B and 7C are graphs showing examples of acoustic energy of music according to the first embodiment.
Figure 7B:
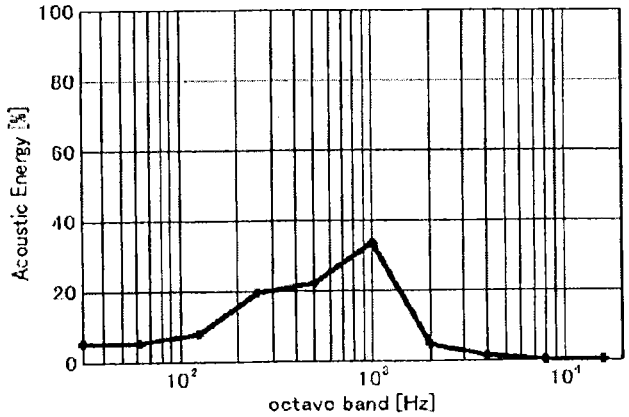
Figure 7C:
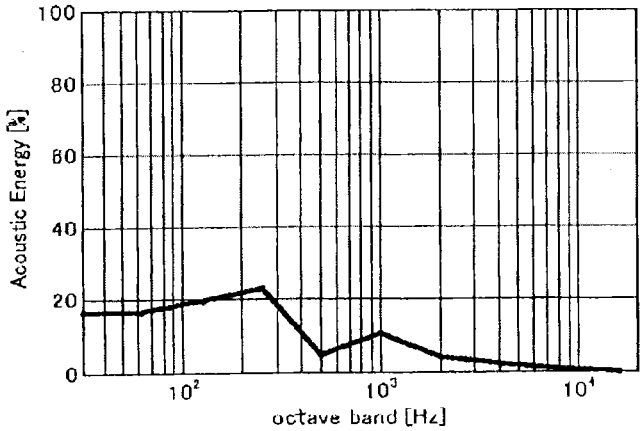

FIGS. 7A~7C shows a ratio (contribution ratio) of acoustic energy included in each frequency band of music to OA value. As shown in FIGS. 7A~7C, a large part of the acoustic energy of music is included in the robust band. Furthermore, in the robust band, especially, a frequency band of sound reproduction to be mainly listened (such as person's singing a song) exists around the first open resonance frequency. Briefly, by relatively enlarging (increasing) the acoustic energy included in frequency band around the first open resonance frequency than an acoustic energy included in other frequency bands, a listener can clearly listen to the sound reproduction to be mainly listened. As a result, irrespective of type of the earphone to be inserted, listening of unclear sound can be reduced, and sound quality in case of insertion of the earphone can be further improved.

Accordingly, in the first embodiment, in order to relatively enlarge (increase) the acoustic energy included in the robust band (especially, around the first open resonance frequency) than an acoustic energy included in other frequency bands, an acoustic impedance $Z_d$ of tympanum is adjusted as parameter. Briefly, by adjusting this parameter, the correction filter is generated. Hereinafter, in the equation (4), an acoustic impedance of denominator is $Z_{d1}$, an acoustic impedance of numerator is $Z_{d2}$, and $Z_{d1}$ and $Z_{d2}$ are respectively used as the parameter.

In FIG. 1, the generation unit 200 includes a tympanum distance acquisition unit 210, a tympanum coefficient acquisition unit 220, and a correction filter generation unit 230.

The tympanum distance acquisition unit 210 obtains a distance (tympanum distance) $L_4$ from entrance of the listener's external auditory canal to the tympanum. Here, for example, an average of the tympanum distance of general person is previously examined, and this average is previously stored in the storage unit 400. The tympanum distance acquisition unit 210 obtains the average of tympanum distance stored in the storage unit 400 as the tympanum distance $L_4$. The tympanum distance acquisition unit 210 supplies the tympanum distance $L_4$ to the correction filter generation unit 230.

The tympanum coefficient acquisition unit 220 generates acoustic impedance (tympanum coefficient) $Z_{d1}$ and $Z_{d2}$ of tympanum of closed resonance and open resonance for each (predetermined) frequency band. Here, a gain of open resonance frequency included in frequency band (robust band) of which acoustic particle velocity at entrance of external auditory canal is almost constant (irrespective of the earphone) is higher than a gain of other open resonance frequencies. The tympanum coefficient acquisition unit 220 supplies the tympanum coefficients $Z_{d1}$ and $Z_{d2}$ to the correction filter generation unit 230.

As shown in FIG. 3, among a plurality of open resonance frequencies, the first open resonance frequency is included in the robust band (<10 kHz). Furthermore, a part of the second open resonance frequency is included in the robust band. However, due to external auditory canal-characteristic, the second open resonance frequency is not partially included in the robust band.

Accordingly, in the first embodiment, the tympanum coefficient acquisition unit 220 generates tympanum coefficients $Z_{d1}$ and $Z_{d2}$ to heighten a gain G1 of the first open resonance frequency included in the robust band than a gain G2 of the second (third, fourth, . . . ) open resonance frequency, irrespective of external auditory canal-characteristic. Here, for example, tympanum coefficients $Z_{d1}$ and $Z_{d2}$ previously set can be obtained from the storage unit 400. Furthermore, by using functions shown as equations (2) and (4), the correction filter generation unit 230 may analytically calculate tympanum coefficients $Z_{d1}$ and $Z_{d2}$. For example, by setting initial values of tympanum coefficients $Z_{d1}$ and $Z_{d2}$ for each band, and by changing tympanum coefficients $Z_{d1}$ and $Z_{d2}$ from the initial values, calculation to search tympanum coefficients $Z_{d1}$ and $Z_{d2}$ may be repeated until completion condition "G1>G2". Moreover, conventional algorithm can be used for this repeat calculation.

The correction filter generation unit 230 obtains the tympanum distance L4 from the tympanum distance acquisition unit 210, and obtains the tympanum coefficients $Z_{d1}$ and $Z_{d2}$ from the tympanum coefficient acquisition unit 220. Furthermore, the correction filter generation unit 230 obtains each variable and constant (Hereinafter, they are called parameters) from the storage unit 400. By substituting each parameter for the equations (2) and (4), the correction filter generation unit 230 calculates a correction filter Q shown in the equation (5). Here, as mentioned-above, while the tympanum coefficients $Z_{d1}$ and $Z_{d2}$ are being searched, the correction filter Q may be calculated by repeat calculation. The correction filter Q (frequency area) is, for example, by converting to impulse response (time area) with Inverse Fast Fourier Transform (IFFT), stored as scalar column vector of impulse filter coefficients into the storage unit 400.

Moreover, as to the correction filter Q shown in the equation (5), a delay of propagation from the loudspeaker 510 to the external auditory canal in case of non-insertion of earphone (as an identity matrix) is ignored, and the phase characteristic represents an advance characteristic. Accordingly, by performing delay processing (as the delay) thereto, the phase characteristic can be converted to a delay characteristic.

Figure 8A:
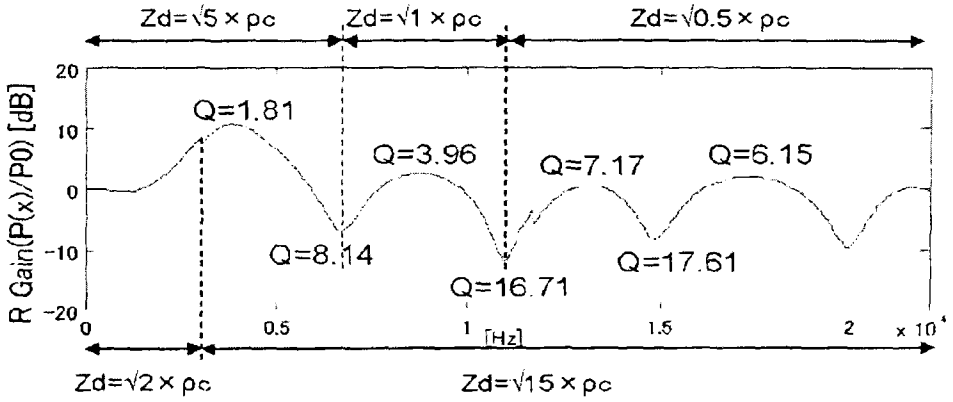
FIGS. 8A and 8B are schematic diagrams showing the correction filter according to the first embodiment.
Figure 8B:
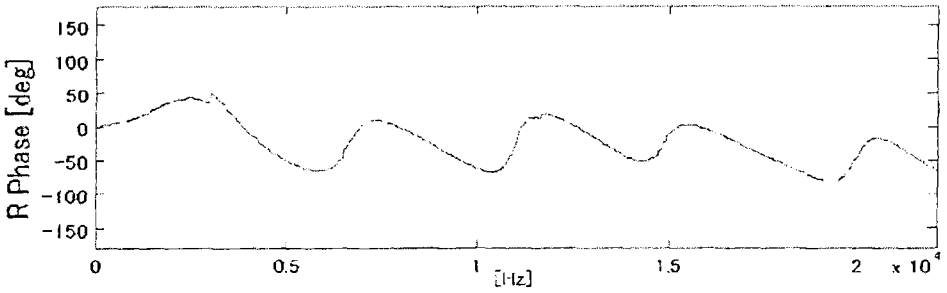

FIGS. 8A and 8B show one example of the correction filter generated using the acoustic propagation model shown in FIG. 3. Here, a tympanum coefficient $Z_{d1}$ of closed resonance is $\sqrt{2}\times\rho c$ in frequency smaller than 3 kHz, and $\sqrt{10}\times\rho c$ in frequency larger than (or equal to) 3 kHz. Furthermore, a tympanum coefficient $Z_{d2}$ of open resonance is $\sqrt{10}$ in frequency smaller than the first closed resonance frequency, $\sqrt{1}\times\rho c$ in frequency larger than (or equal to) the first closed resonance frequency and smaller than the second closed resonance frequency, and $\sqrt{0.5}\times\rho c$ in frequency larger than (or equal to) the second closed resonance frequency.

In FIGS. 8A and 8B, the correction filter includes a notch at a plurality of frequency bands (second frequency band) to suppress closed resonance occurred in the external auditory canal when the external auditory canal is closed by the earphone. Furthermore, the correction filter includes a peak at a plurality of frequency bands (first frequency band) to add open resonance occurred in the external auditory canal when the external auditory canal is opened. Here, peak and notch are mutually appeared on a frequency axis, and respective intervals between peak and notch (mutually adjacent) on the frequency axis are partially unequal.

Here, as an external auditory canal model in case of insertion of earphone, in the correction filter based on the acoustic tube model of which sectional area perpendicular to X-axis is uniform, peak and notch are appeared (aligned) at an equal interval. On the other hand, in the first embodiment, the correction filter is based on an acoustic tube model that a ratio of a sectional area $S_1$ perpendicular to X axis at exit of earphone to a sectional area $S_2$ perpendicular to X axis at entrance of external auditory canal is taken into consideration, as the external auditory canal model in case of insertion of earphone. In this case, as mentioned-above, respective intervals between peak and notch (mutually adjacent) on the frequency axis are partially unequal. Accordingly, by using this correction filter, sound quality in case of insertion of earphone can be neared to (natural) sound quality in case of non-insertion of earphone.

Furthermore, in the correction filter shown in FIGS. 8A and 8B, a gain (maximum) of a peak (first) at the lowest frequency side included in the robust band is higher than the highest gain among gains (maximums) of other peaks (second, third, fourth, . . . ). Accordingly, by using this correction filter, a contribution ratio of acoustic energy of sound reproduction included in the robust band (especially, around the first resonance frequency) can be relatively enlarged (increased) than a contribution ratio of acoustic energy included in other frequency bands. As a result, irrespective of type of the earphone to be inserted, sound quality can be further improved.

Furthermore, in the correction filter shown in FIGS. 8A and 8B, by setting the tympanum coefficients $Z_{d1}$ and $Z_{d2}$ as mentioned-above, Q-value of peak is smaller than Q-value of notch, and Q-value of first peak at the lowest frequency side is smaller than "3". Furthermore, Q-value of second peak is smaller than "5". Moreover, by using frequency f0 at a maximum of each peak and frequency width Δf at a point lower as 3 dB than the maximum, Q-value of peak is calculated by "Q=f0/Δf". Furthermore, by using frequency f0 at a minimum of each notch and frequency width Δf at a point higher as 3 dB than the minimum, Q-value of notch is calculated by "Q=f0/Δf".

When Q-value is larger, attenuation characteristic of the peak is steeper. On the other hand, when Q-value is smaller, attenuation characteristic of the peak is smoother. As shown in the correction filter of FIGS. 8A and 8B, if Q-value of first (or second) peak is relatively small, in comparison with Q-value as a large value, a gain of wide range band can be increased or reduced by smooth attenuation characteristic. Accordingly, for example, even if first (or second) open resonance frequency is slightly different due to the listener's external auditory canal characteristic (individual difference), the first (or second) open resonance frequency is included in a band of first (or second) peak. By increasing a gain of this band, influence of the individual difference can be reduced. As a result, irrespective of type of the earphone, and irrespective of the listener, sound quality in case of insertion of earphone can be further neared to (natural) sound quality in case of non-insertion of earphone.

By using the correction filter generated by the correction filter generation unit 230, the correction unit 300 corrects the sound reproduction signal. Here, the correction unit 300 heightens a gain of first open resonance frequency included in the robust band than a gain of second (third, fourth, . . . ) open resonance frequency.

In FIG. 1, the correction unit 300 includes a sound reproduction signal acquisition unit 310, a correction filter acquisition unit 320, a sound reproduction signal correction unit (correction unit) 330, and an output unit 340.

The sound reproduction signal acquisition unit 310 acquires a sound reproduction signal (first sound reproduction signal) from outside, and supplies the sound reproduction signal to the sound reproduction correction unit 330. As a method for the sound reproduction signal acquisition unit 310 to acquire the sound reproduction signal, various methods are used. For example, by reading contents stored in recording medium such as a CD, a DVD, or a stored-disk device, a sound reproduction signal included in the contents is acquired. Furthermore, contents may be acquired via a network such as Internet, a ground wave or satellite broadcasting.

The correction filter acquisition filter 320 obtains the correction filter (scalar column vector of impulse filter coefficient) from the storage unit 400, and supplies the correction filter to the sound reproduction signal correction unit 330.

The sound reproduction signal correction unit 330 obtains the sound reproduction signal from the sound reproduction signal acquisition unit 310, and the correction filter from the correction filter acquisition unit 320. By convoluting the correction filter (impulse filter coefficient) with the sound reproduction signal (i.e., executing FIR operation to the sound reproduction signal using the correction filter), the sound reproduction signal correction unit 330 generates a corrected sound reproduction signal (second sound reproduction signal). The sound reproduction signal correction unit 330 supplies the corrected sound reproduction signal to the output unit 340.

The output unit 340 obtains the corrected sound reproduction signal from the sound reproduction signal correction unit 330. If necessary, by amplifying amplitude of the signal with a user's input, the output unit 340 outputs the corrected sound reproduction signal to an earphone connected to the sound reproduction apparatus 100. By inserting the earphone so as to close a listener's external auditory canal, the listener can listen to sound (such as music) from the corrected sound reproduction signal.

According to the sound reproduction apparatus 100 of the first embodiment, irrespective of the earphone to be inserted, sound quality in case of insertion of earphone can be neared to sound quality in case of non-insertion of earphone.

The Second Embodiment

Figure 9:
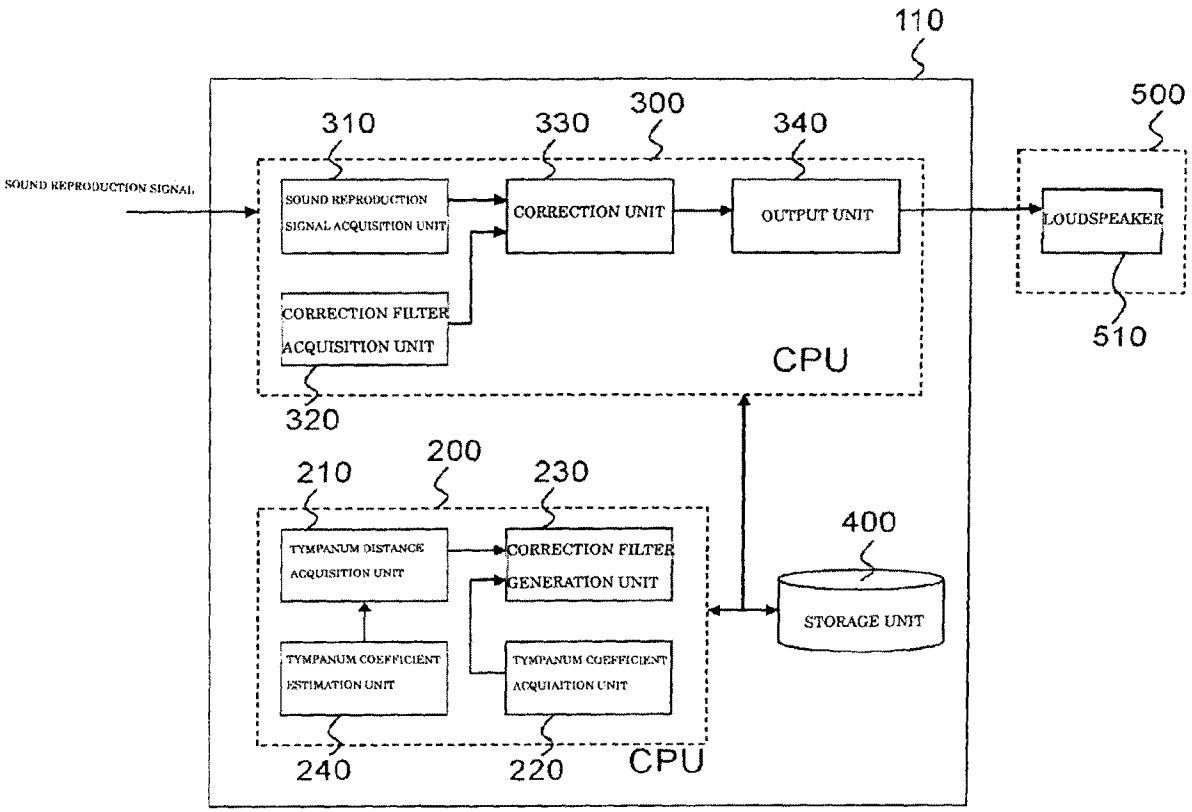
FIG. 9 is a block diagram of the sound reproduction apparatus according to the second embodiment.

FIG. 9 is a block diagram of a sound reproduction apparatus 110 of the second embodiment. The sound reproduction apparatus 110 includes a tympanum coefficient estimation unit 240 to estimate the listener's tympanum distance L4, which is different from the sound reproduction apparatus 100. Moreover, as to the same unit as the sound reproduction apparatus 100 of the first embodiment, the same sign is assigned, and explanation thereof is omitted.

In the equation (1), by substituting "x=L4, k=2π f/c" and by setting a denominator to zero, a closed resonance frequency at a tympanum position can be calculated. However, when the closed resonance frequency is given using the equation (1), estimation of the tympanum distance L4 is difficult.

In FIG. 3, as to the acoustic propagation model in the listener's external auditory canal with the earphone and the acoustic propagation model in the listener's external auditory canal without the earphone, model error due to difference of the listener's external auditory canal characteristic and the earphone characteristic is included. However, in comparison with change of the second closed resonance frequency by this model error, change of the first closed resonance frequency thereby is relatively few. Accordingly, by using the first closed resonance frequency $f_c$, if the tympanum L4 is represented as tube resonance system (equation (8)) in the external auditory canal, a rough estimation from the closed resonance frequency to the tympanum distance is simply possible.

$$L4 = \frac{c}{2f_c} \tag{8}$$

The tympanum coefficient estimation unit 240 supplies a sweep periodic sound signal or a pulse sound signal to the output unit 340. The output unit 340 outputs the sweep periodic sound signal or the pulse sound signal to the loudspeaker 510 of the earphone 500. While a listener is listening to the sweep periodic sound signal or the pulse sound signal via the earphone 500, the listener indicates the highest frequency by input means (not shown in FIG. 9). In this case, the tympanum coefficient estimation unit 240 specifies this frequency as the first closed resonance frequency.

By using the first closed resonance frequency (specified) and the equation (8), the tympanum coefficient estimation unit 240 calculates an estimation value of the tympanum distance L4.

According to the sound reproduction apparatus 110 of the second embodiment, the correction filter generation unit 230 uses the estimation value of the tympanum distance L4 calculated by the tympanum coefficient estimation unit 240. As a result, the correction filter matched with the listener's external auditory canal characteristic can be generated.

The Third Embodiment

Figure 10:
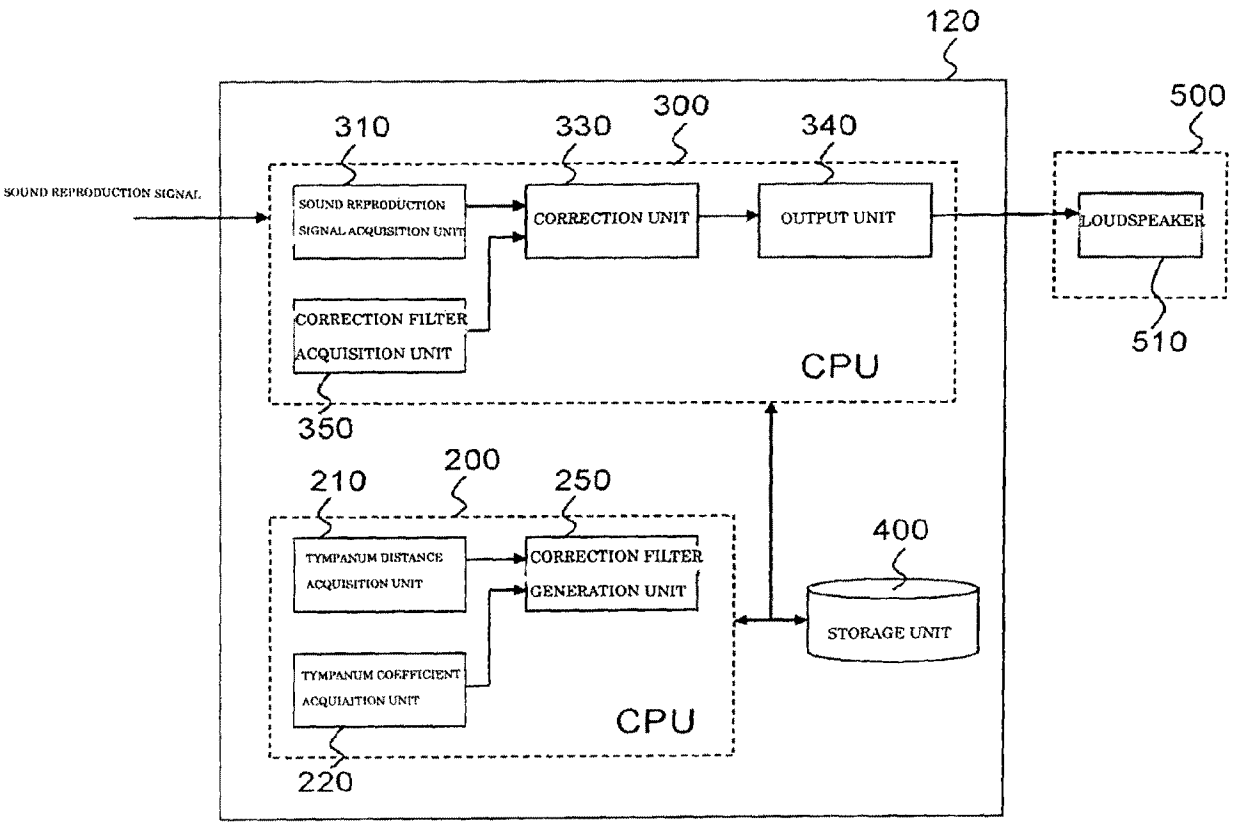
FIG. 10 is a block diagram of the sound reproduction apparatus according to the third embodiment.
Figure 11A:
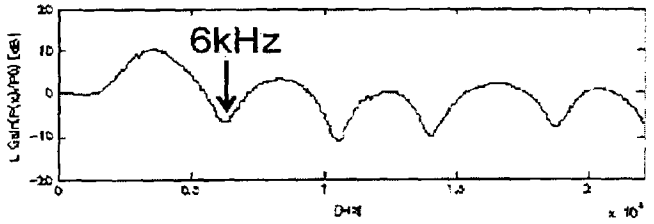
FIGS. 11A, 11B, 11C and 11D are schematic diagrams showing the correction filter according to the third embodiment.
Figure 11B:
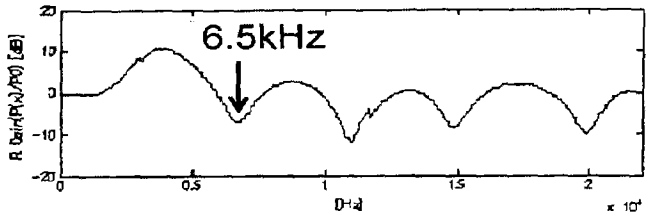
Figure 11C:
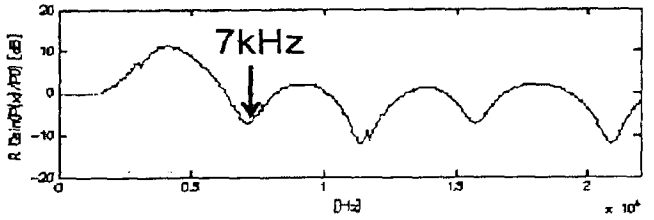
Figure 11D:
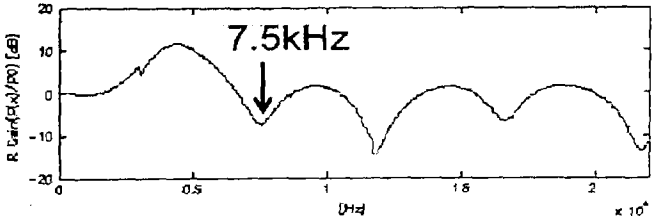

FIG. 10 is a block diagram of a sound reproduction apparatus 120 of the third embodiment. In the sound reproduction apparatus 120, a correction filter generation unit 250 generates respective correction filters matched with a plurality of listeners, which is different from the sound reproduction apparatus 100. Moreover, as to the same unit as the sound reproduction apparatus 100 of the first embodiment, the same sign is assigned, and explanation thereof is omitted.

As mentioned-above, in FIG. 3, as to the acoustic propagation model in the listener's external auditory canal with the earphone and the acoustic propagation model in the listener's external auditory canal without the earphone, the model error is included. Furthermore, as shown in FIGS. 11A~11D, the first closed resonance frequency of persons who have few influences due to the model error is approximately classified into four, i.e., 6 kHz, 6.5 kHz, 7 kHz, and 7.5 kHz.

By using four values ($f_{c1}$=6 kHz, $f_{c2}$=6.5 kHz, $f_{c3}$=7 kHz, $f_{c4}$=7.5 kHz) of the first resonance frequency and the equation (8), the tympanum distance calculation unit 210 calculates four tympanum distances L4 corresponding to respective first resonance frequency.

By using four tympanum distances L4 (calculated by the tympanum distance calculation unit 210) and the equation (5), the correction filter generation unit 250 generates correction filters corresponding to the four tympanum distances L4, and stores the correction filters into the storage unit 400.

According to the sound reproduction apparatus 120 of the third embodiment, for example, after a listener selects a correction filter (as the most suitable filter for the listener by previous listening) via input means, the correction filter acquisition unit 350 can obtain the correction filter from the storage unit 400. As a result, by using the correction filter most suitable for the listener's external auditory canal characteristic, the correction unit 330 can correct the sound reproduction signal.

According to the sound reproduction apparatus and the sound reproduction-correction method of at least one of the first, second and third embodiments, irrespective of the earphone to be inserted, sound quality in case of insertion of the earphone can be neared to sound quality in case of non-insertion of the earphone.

In the disclosed embodiments, the processing can be performed by a computer program stored in a computer-readable medium.

In the embodiments, the computer readable medium may be, for example, a magnetic disk, a flexible disk, a hard disk, an optical disk (e.g., CD-ROM, CD-R, DVD), an optical magnetic disk (e.g., MD). However, any computer readable medium, which is configured to store a computer program for causing a computer to perform the processing described above, may be used.

Furthermore, based on an indication of the program installed from the memory device to the computer, OS (operating system) operating on the computer, or MW (middle ware software), such as database management software or network, may execute one part of each processing to realize the embodiments.

Furthermore, the memory device is not limited to a device independent from the computer. By downloading a program transmitted through a LAN or the Internet, a memory device in which the program is stored is included. Furthermore, the memory device is not limited to one. In the case that the processing of the embodiments is executed by a plurality of memory devices, a plurality of memory devices may be included in the memory device.

A computer may execute each processing stage of the embodiments according to the program stored in the memory device. The computer may be one apparatus such as a personal computer or a system in which a plurality of processing apparatuses are connected through a network. Furthermore, the computer is not limited to a personal computer. Those skilled in the art will appreciate that a computer includes a processing unit in an information processor, a microcomputer, and so on. In short, the equipment and the apparatus that can execute the functions in embodiments using the program are generally called the computer.

While certain embodiments have been described, these embodiments have been presented by way of examples only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An apparatus for generating a sound reproduction to a loudspeaker of an earphone to be inserted into a listener's ear, the earphone including a case closing an external auditory canal extended from a tympanum of the listener's ear, and an opening toward the external auditory canal, the apparatus comprising:

a storage unit configured to store a correction filter in which a maximum of a gain at a frequency band lower than or equal to 10 kHz is larger than a maximum of a gain at a frequency band higher than 10 kHz, the correction filter having a peak including the maximum of the gain respectively at a plurality of first frequency bands to add an open resonance that occurred in the external auditory canal opened, the maximum at the lowest first frequency band lower than 10 kHz among the first frequency bands being the largest among all maximums at the first frequency bands;

an acquisition unit configured to acquire a first sound reproduction signal;

a correction unit configured to generate a second sound reproduction signal by convoluting the correction filter with the first sound reproduction signal; and an output unit to output the second sound reproduction signal to the loudspeaker of the earphone.

2. The apparatus according to claim 1, wherein the correction filter has a notch including a minimum of the gain respectively at a plurality of second frequency bands to suppress a closed resonance occurred in the external auditory canal closed by the earphone.

3. The apparatus according to claim 1, wherein the storage unit stores the correction filter as a filter coefficient of an impulse response.

4. The apparatus according to claim 1, further comprising:

a generation unit configured to generate the correction filter by using a transfer function based on a ratio of a sectional area of the opening to a sectional area of the external auditory canal, and a distance from the opening to the tympanum;

wherein the correction unit convolutes the correction filter generated by the generation unit, with the first sound reproduction signal.

5. The apparatus according to claim 4, further comprising:

a second storage unit configured to store the sectional area of the opening, the sectional area of the external auditory canal, and the distance;

wherein the generation unit calculates the transfer function by using the sectional area of the opening, the sectional area of the external auditory canal, and the distance stored in the second storage unit.

6. The apparatus according to claim 4, further comprising:

a second storage unit configured to store the sectional area of the opening, and the sectional area of the external auditory canal; and an estimation unit configured to estimate the distance from the opening to the tympanum;

wherein the generation unit calculates the transfer function by using the sectional area of the opening and the sectional area of the external auditory canal stored in the second storage unit, and the distance estimated by the estimation unit.

7. A non-transitory computer readable medium that stores a correction filter to correct a sound reproduction in an apparatus for generating the sound reproduction to a loudspeaker of an earphone to be inserted into a listener's ear, the earphone including a case closing an external auditory canal extended from a tympanum of the listener's ear, and an opening toward the external auditory canal, wherein, in the correction filter, a maximum of a gain at a frequency band lower than or equal to 10 kHz is larger than a maximum of a gain at a frequency band higher than 10 kHz, the correction filter has a peak including the maximum of the gain respectively at a plurality of first frequency bands to add an open resonance that occurred in the external auditory canal opened, and the maximum at the lowest first frequency band lower than 10 kHz among the first frequency bands is the largest among all maximums at the first frequency bands.

8. The non-transitory computer readable medium according to claim 7, wherein the correction filter has a notch including a minimum of the gain respectively at a plurality of second frequency bands to suppress a closed resonance occurred in the external auditory canal closed by the earphone, the peak and the notch are mutually aligned on a frequency axis, and respective intervals between the peak and the notch adjacent are partially unequal.

9. The non-transitory computer readable medium according to claim 8, wherein Q-value of the peak is smaller than Q-value of the notch.

10. The non-transitory computer readable medium according to claim 9, wherein Q-value of the peak at the lowest first frequency band is smaller than two.

11. The non-transitory computer readable medium according to claim 7, wherein the correction filter is stored as a filter coefficient of an impulse response.

12. A method in an apparatus for generating a sound reproduction by using a correction filter, to a loudspeaker of an earphone to be inserted into a listener's ear, the earphone including a case closing an external auditory canal extended from a tympanum of the listener's ear, and an opening toward the external auditory canal, in the correction filter, a maximum of a gain at a frequency band lower than or equal to 10 kHz being larger than a maximum of a gain at a frequency band higher than 10 kHz, the correction filter having a peak including the maximum of the gain respectively at a plurality of first frequency bands to add an open resonance that occurred in the external auditory canal opened, the maximum at the lowest first frequency band lower than 10 kHz among the first frequency bands being the largest among all maximums at the first frequency bands, the method comprising:

acquiring a first sound reproduction signal; and generating a second sound reproduction signal by heightening a gain of the first sound reproduction signal at the lowest first resonance frequency among a plurality of first resonance frequencies having the open resonance occurred in the external auditory canal opened, than a maximum of a gain of the first sound reproduction signal at other first resonance frequencies.

13. The method according to claim 12, wherein the second sound reproduction signal is generated by lowering the gain of the first sound reproduction signal at a plurality of second resonance frequencies having a closed resonance occurred in the external auditory canal closed by the earphone.

14. The method according to claim 12, further comprising:

generating a correction filter by using a transfer function based on a ratio of a sectional area of the opening to a sectional area of the external auditory canal, and a distance from the opening to the tympanum; and convoluting the correction filter with the first sound reproduction signal.

15. The method according to claim 14, further comprising:

storing the sectional area of the opening, the sectional area of the external auditory canal, and the distance; and calculating the transfer function by using the sectional area of the opening, the sectional area of the external auditory canal, and the distance.

16. The method according to claim 14, further comprising:

storing the sectional area of the opening, and the sectional area of the external auditory canal;

estimating the distance from the opening to the tympanum; and calculating the transfer function by using the sectional area of the opening, the sectional area of the external auditory canal, and the distance estimated.

* * * * *